US009410412B2

(12) United States Patent
Stout

(10) Patent No.: US 9,410,412 B2
(45) Date of Patent: Aug. 9, 2016

(54) MULTIZONE FRAC SYSTEM

(71) Applicant: Completion Tool Development, LLC, Willis, TX (US)

(72) Inventor: Gregg W. Stout, Montgomery, TX (US)

(73) Assignee: Completion Tool Development, LLC, Willis, TX (US)

( * ) Notice: Subject to any disclaimer, the term of this patent is extended or adjusted under 35 U.S.C. 154(b) by 755 days.

(21) Appl. No.: 13/848,494

(22) Filed: Mar. 21, 2013

(65) Prior Publication Data

US 2013/0264056 A1 Oct. 10, 2013

Related U.S. Application Data

(60) Provisional application No. 61/613,540, filed on Mar. 21, 2012.

(51) Int. Cl.

| | |
|---|---|
| ***E21B 43/26*** | (2006.01) |
| ***E21B 33/12*** | (2006.01) |
| ***E21B 23/00*** | (2006.01) |
| ***E21B 43/11*** | (2006.01) |
| ***E21B 23/08*** | (2006.01) |
| ***E21B 33/126*** | (2006.01) |
| ***E21B 43/116*** | (2006.01) |

(52) U.S. Cl.

CPC ..... *E21B 43/261* (2013.01); *E21B 23/08* (2013.01); *E21B 33/1204* (2013.01); *E21B 33/126* (2013.01); *E21B 43/116* (2013.01); *E21B 43/26* (2013.01)

(58) Field of Classification Search

CPC ..... E21B 23/08; E21B 23/01; E21B 23/02; E21B 23/00; E21B 43/261; E21B 43/26; E21B 43/116; E21B 33/129; E21B 33/122; E21B 33/126; E21B 33/1204; E21B 33/261; E21B 34/14

USPC ..... 166/192, 121, 126, 55, 120, 281

See application file for complete search history.

(56) References Cited

U.S. PATENT DOCUMENTS

| | | | | |
|---|---|---|---|---|
| 2,868,297 | A * | 1/1959 | Lamberson, Jr. | E21B 23/02 166/121 |
| 4,928,772 | A * | 5/1990 | Hopmann | 166/386 |
| 4,940,094 | A * | 7/1990 | Lessi | E21B 23/08 166/154 |
| 5,549,161 | A * | 8/1996 | Gomez et al. | 166/255.1 |
| 7,150,318 | B2 * | 12/2006 | Freeman | E21B 34/14 166/255.1 |
| 7,387,165 | B2 * | 6/2008 | Lopez de Cardenas et al. | 166/313 |

(Continued)

FOREIGN PATENT DOCUMENTS

CA WO 2011134069 A1 * 11/2011 ..... E21B 43/26

*Primary Examiner* — Michael Wills, III

(74) *Attorney, Agent, or Firm* — Tumey L.L.P.

(57) ABSTRACT

An array of plugging devices are pumped sequentially from the surface through a liner that typically becomes horizontal in nature, where each plugging device is anchorable at a specific position along the length of the line. Perforations are generated above the plugging device. The plugging device may be a cup plug and when pump pressure is applied to the cup the cup moves through the liner. When anchored, the cup directs frac fluids through the perforations to treat the well formation. The plug may be of the type where a full bore is maintained through the liner and allows the cup plug to travel back to the surface due to flow from the well thus eliminating any need for milling obstructions from the well bore. The use of multiple plugging devices allows multizone stage fracing.

15 Claims, 7 Drawing Sheets

(56) References Cited

U.S. PATENT DOCUMENTS

| | | | | |
|---|---|---|---|---|
| 7,556,102 | B2 * | 7/2009 | Gomez | 166/373 |
| 7,861,774 | B2 * | 1/2011 | Fehr et al. | 166/191 |
| 7,926,580 | B1 * | 4/2011 | Darnell et al. | 166/386 |
| 2003/0127227 | A1 * | 7/2003 | Fehr et al. | 166/306 |
| 2004/0112588 | A1 * | 6/2004 | Mullins | E21B 37/00 166/177.3 |
| 2004/0238173 | A1 * | 12/2004 | Bissonnette et al. | 166/307 |
| 2005/0072577 | A1 * | 4/2005 | Freeman | 166/386 |
| 2009/0194947 | A1 * | 8/2009 | Templeton | E21B 33/126 277/335 |
| 2011/0088891 | A1 | 4/2011 | Stout | |
| 2011/0180274 | A1 * | 7/2011 | Wang | E21B 34/14 166/386 |
| 2011/0308817 | A1 * | 12/2011 | Ravensbergen | 166/382 |
| 2012/0090847 | A1 * | 4/2012 | Getzlaf | E21B 23/02 166/305.1 |
| 2013/0168098 | A1 * | 7/2013 | Campbell | E21B 34/14 166/308.1 |
| 2014/0196888 | A1 * | 7/2014 | Martin et al. | 166/192 |

* cited by examiner

MULTIZONE FRAC SYSTEM

This application claims priority to Provisional Application Serial No. 61/613,540 filed on Mar. 21, 2012.

BACKGROUND OF INVENTION

1. Field of the Invention

The present invention relates to apparatus and methods for oil and gas wells to enhance the production of subterranean wells, either open hole, cased hole, or cemented in place and more particularly to improved multizone stimulation systems.

2. Description of Related Art

Wells are drilled to a depth in order to intersect a series of formations or zones in order to produce hydrocarbons from beneath the earth. Some wells are drilled horizontally through a formation and it is desired to section the wellbore in order to achieve a better stimulation along the length of the horizontal wellbore. The drilled wells are cased and cemented to a planned depth or a portion of the well is left open hole.

Producing formations intersect with the well bore in order to create a flow path to the surface. Stimulation processes, such as fracing or acidizing are used to increase the flow of hydrocarbons through the formations. The formations may have reduced permeability due to mud and drilling damage or other formation characteristics. In order to increase the flow of hydrocarbons through the formations, it is desirable to treat the formations to increase flow area and permeability. This is done most effectively by setting either open-hole packers or cased-hole packers at intervals along the length of the wellbore or cementing in the horizontal liner. When using packers the packers isolate sections of the formations so that each section can be better treated for productivity. Between the packers is a frac port and in some cases a sliding sleeve or a casing that communicates with the formation. In order to direct a treatment fluid through a frac port and into the formation, a seat or valve may be placed close to a sliding sleeve or below a frac port. A ball may be dropped to land on the seat in order to direct fluid through the frac port and into the formation.

One method, furnished by PackersPlus, places a series of ball seats below the frac ports covered by sliding sleeves with each seat size accepting a different ball size. Smaller diameter seats are at the bottom of the completion and the seat size increases for each zone as you go up the well. For each seat size there is a ball size so the smallest ball is dropped first to clear all the larger seats until it reaches the appropriate seat. In cases where many zones are being treated, maybe as many as 20 zones or more, the seat diameters have to be very close. The balls that are dropped have less surface area to land on as the number of zones increase. With less seat surface to land on, the amount of pressure you can put on the ball, especially at elevated temperature, becomes less and less. This means you can't get adequate pressure to frac the zone because the ball is so weak, so the ball blows through the seat. Furthermore, the small ball seats reduce the I.D. of the production flow path which creates other problems. The small I.D. prevents re-entry of other downhole devices, i.e., plugs, running and pulling tools, shifting tools for sliding sleeves, perforating gun size (smaller guns, less penetration), and of course production rates. In order to remove the seats, a milling run is needed to mill out all the seats and any balls that remain in the well.

The size of the ball seats and related balls limits the number of zones that can be treated in a single trip.

It would be advantageous to have a system that had no ball seats that restrict the I.D. of the tubing and to eliminate the need to spend the time and expense of milling out the ball seats, not to mention the debris created by the milling operation. Also, it would be advantages to eliminate the restricted flow paths due to the small I.D. of the ball seats that could potential restrict production.

Another method of completion is called "Plug and Perf". In these completions the liner may be cemented in throughout the length of the horizontal section. Typically, composite plugs are run into the well on electric line and pumped out the horizontal section toward the toe until the composite plug is below the section of the zone to be fraced. Once at the desired location, a setting tool is actuated and the composite plug sets inside of the liner. Perforating guns are sometimes run in the same electric line trip where once the composite plug is set, the guns and setting tool release away from the composite plug and are moved up to a location where the liner is perforated with the guns. Once perforated, the spent perforating gun and setting tool are returned to the surface. Frac fluid is then pumped into the well in order to frac the zone. After treatment, the next composite plug with setting tool and perforating guns is run to the next upper zone section and the process described above is repeated and obviously this becomes very time consuming. This process can be repeated many times and in some cases up to 40 times. Once all zones have been fraced, a coiled tubing unit runs coiled tubing into the well with a motor and mill attached and all of the composite plugs are milled out. The composite plug mill debris is flowed back to the surface and the well is put on production.

It would be advantageous, and cost effective, to have a system and method where no wireline trucks were required to perform electric line runs to run and set composite plugs, perforate, and return tools to the surface. Furthermore, it would be advantageous and cost effective, to eliminate the need to call a coiled tubing unit to location to mill out the composite plugs.

The "Plug and Perf" method is sometimes desired over the sliding sleeve method because last minute changes can be made on zone spacing since the composite plugs can be set at any location along the length of the well. The present invention offers a solution to making position changes of the plug in the liner at the last minute by use of selective key profiles located at each liner coupling. Casing liner comes in length increments ranging from 30 to 40 feet and typical stage zone lengths vary maybe from 300 feet to 500 feet. So, for example, a 300 foot zone may have about 9 selective profiles to choose from when anchoring or positioning a cup plug. Therefore, a plug key profile can be selected at the surface to match a liner coupling profile where the plug is desired to land and anchor in place. The plug key profile can be designed to pass certain liner coupling profiles until the plug finds the correct profile. The plug key profile is also designed to easily disengage from the from the liner coupling profile so that flow from the well will return the plug back to the surface thus eliminating the need to mill out the plug.

The "Plug and Perf" method can also use a conventional wireline conveyed perforating gun attached to the top of the cup plug. In this case the cup plug serves a dual purpose, i.e., first, conveys the tools to a location, and second, provides a seal to frac against. It would be advantageous to use the cup plug as a power means to pump the perforating guns out the horizontal wellbore and land the cup plug in a profile to positively locate the guns along the horizontal section. The perforating guns could be detached from the cup plug by different means, i.e., apply pump pressure to the cup and jar up on the guns to release from the plug or incorporate an electrical triggered release device between the guns and the cup plug. Once the perforating gun is released from the cup plug, the gun is positioned at selected locations above the plug. A single shot gun can be used or a select fire can be used to generate a series of perforation clusters within a zone.

The invention is not to be limited to wireline, or electric line, conveyed guns attached to the cup plug since a pressure actuated type gun can be attached to the top of the cup plug providing safety issues can be resolved in cases where the guns do not fire and have to return to the surface for disarmament. This would be advantageous since a wireline trip would be eliminated.

SUMMARY OF THE INVENTION

This invention provides an improved completion system for wells where stage fracing is desired for horizontal wells. The invention includes advantages over current systems in order to reduce completion costs and increase production rates. A series of plugs are landed in various full bore profiles where specific profiles are located at pre-selected positions along the length of the horizontal wellbore. The use of a cup on the plug eliminates the need to run an electric line setting tool to set the plug, therefore, the plug can be pumped out a horizontal wellbore once a circulation path is created at the toe of the well. A similar cup plug is described in U.S. provisional patent application Ser. No. 12/925,141 but has been modified and its use expanded per the present invention. The plug does not have to be stroked to a set position, from a run-in position with a setting tool, since the cup on the plug forms a seal with the inside of the liner and directs frac fluid into the formation. A first plug is pumped to a position closest to the toe of the wellbore, the plug engages a profile in the inside diameter of the sleeve that does not let the plug pass. The sleeve then, with the plug located and sealing inside the sleeve, shifts to open a series of frac ports. The first zone is fraced thru the frac ports and then at the right time while pumping, a second plug is released from the surface and pumped out the horizontal section to land in a second pre-selected location in the wellbore. This process is repeated for all zones to be fraced. Once fracing is completed then production begins thereby flowing all the plugs back to surface for retrieval, thus eliminating the need to mill out the plugs. All the profiles used can be varied from zone to zone so that each plug only lands in a certain location. Selection of a plug profile at the surface, even though receiving profiles are already in the well, allows selective plug placement along the horizontal section. The profiles are designed to stop the plugs from going down but allow the plugs to go back up the well to the surface. The full bore profiles also eliminate ball seats that can limit production flow due to flow restrictions. The cup plugs can also be used to pump perforating guns along the wellbore and positively locate the guns before creating perforations in the liner.

DETAILED DESCRIPTION OF THE PREFERRED EMBODIMENTS

Figure 1:
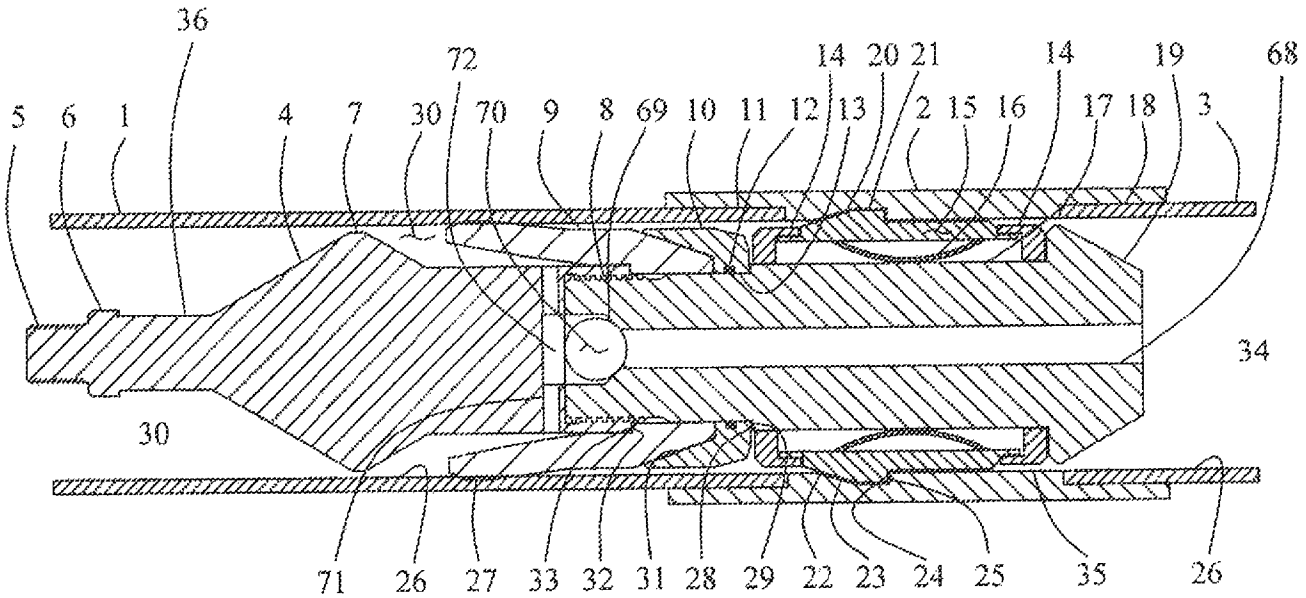
FIG. 1 is a schematic view of the present invention where the cup plug has landed in a liner collar profile. This condition exists when it is desired to position a plug and then perforate above the plug.

With reference to FIG. 1, the cup plug 36 is positioned inside of liner 1 which connects with liner collar 2 at thread 11, and liner 3 connects to liner collar at thread 18. Top sub 4 has standard wireline threaded connection 5 and fish neck 6, that are optional, and finned centralizer 7. Hollow pocket 72 communicates with holes 71 where holes exit under cup 9. Top sub 4 threadably connects at thread 8 to mandrel 19. Hole 68 connects to ball seat 69 where ball 70 is housed. Sealing cup 9 and thimble 10 slide over mandrel 19 over surface 13. Seal 12 seals on surface 13 and cup surface 27 seals at liner surface 26. Cup 9 prevents fluid 30 from traveling to location 34. Thimble 10 has surface 28 that shoulders against mandrel surface 29. A radial series of profile keys 15 are retained to mandrel 19 by retainer rings 14. Key profile 21 expands and matches profile 20 that is located in liner coupling 2. Springs 16 acts on surface 17 and against the inside surfaces of a series of keys 15 to bias the keys outward into profile 20. Surfaces 26, 35, and 26 are nearly the same as to maintain a full bore through the casing or liner. Key shoulders 24 engage against collar shoulder 25 to prevent cup plug 36 from moving downward. Key surfaces 23 is such that they slide on surface 22 of the collar to allow plug 36 to cam keys 15 inward to allow plug 36 to move upward toward the surface. Shoulder 32 of cup 9 engage shoulder 33 of top sub 4 so cup 9 is trapped between top sub 4 and mandrel 19. In lieu of a cup shaped member for the seal, other types of seals such as a Labyrinth type seal could be used as a substitute for sealing cup 9.

Figure 2:
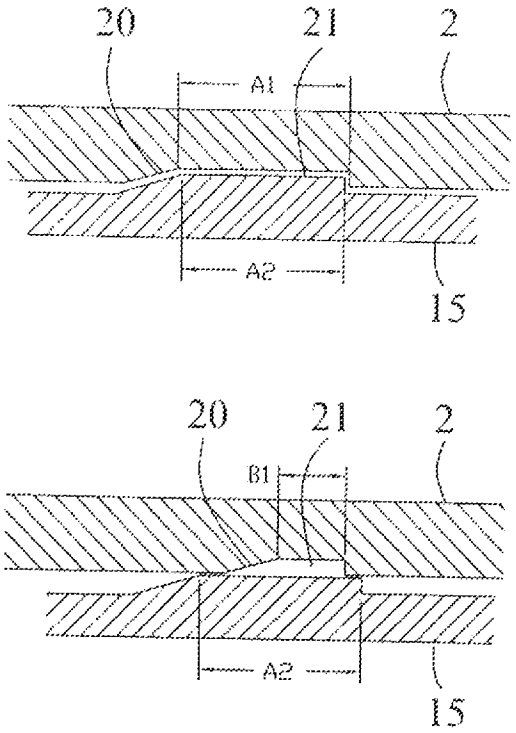
FIG. 2 is a schematic of two different profiles, but only two of many possibilities, illustrating how the profiles can be selective.

With reference to FIG. 2, liner coupling 2 has inner profile 20 and key 15 has outer profile 21. Dimensions A1 and A2 represent lengths of a first set of keys 15 and coupling 2. Dimension B1 represent a second profile 21 for a liner coupling 2. The "A2" dimension of key 15 is longer than the "B1" dimension for liner coupling 2 so the "A2" profile will not engage in liner coupling profile "B1" but will engage in coupling profile "A1". The longer liner coupling 2 dimension "A1" is positioned in the horizontal liner below, or closer to the toe of the horizontal well, than the shorter liner coupling dimension "B1" so the cup plug 36 will pass through liner collar "B1" and stop in liner collar "A1". Profiles 20 and 21 are varied into many combinations in order to increase the number of profile combinations and to allow selective positioning of multiple cup plugs in multiple liner collars.

Figure 3:
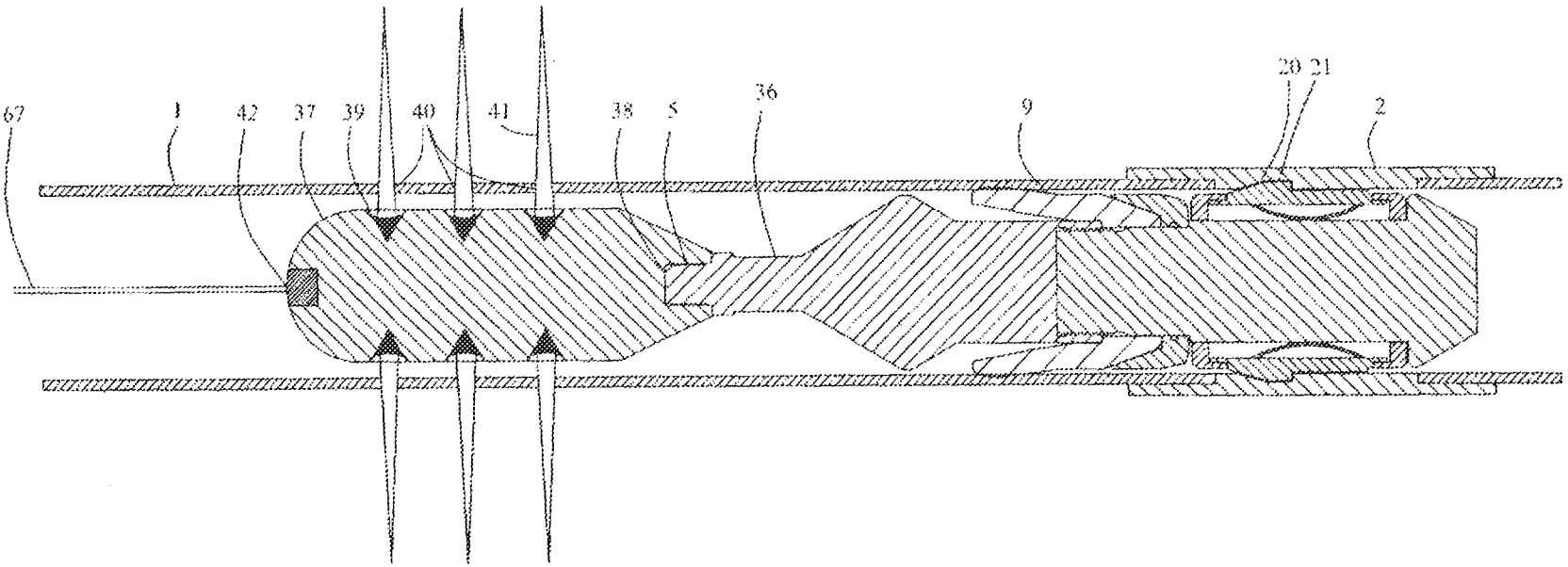
FIG. 3 is a schematic of a wireline conveyed perforating gun attached to a cup plug where the cup plug is used to conveyed the assembly out the wellbore and latch into a profile to locate both the plug and the guns relative to the length of the horizontal section of the wellbore.

FIG. 3 shows a cross-sectional view of the cup plug 36 attached to a perforating gun 37 at thread 5 and shoulder 38. The cup plug 36 has landed in collar 2 in profile 21 with selective key profile 20. Cup 9 is sealing inside of liner 1.

Liner 1 has holes 40 generated from shaped charges 39 and jets 41 from perforating gun 37. Electric line 67 is attached to perforating gun 37 to allow electrical detonation of the guns by the way of firing mechanism 42. Firing mechanism 42 may be of the type use on conventional wireline perforating guns with safety features built in the prevent firing out-of-zone. Also, firing mechanism 42 can be of the pressure actuated type with or without wireline in the hole with the appropriate safety features present. A release mechanism can be added at location 38 in order to detach the perforating guns 37 from plug 36 before or after the guns are detonated.

Figure 4:
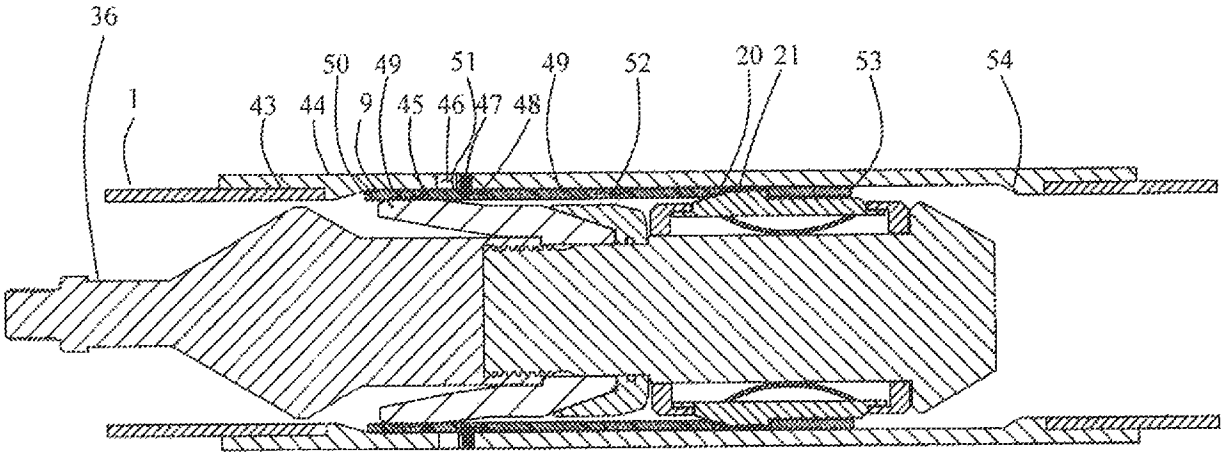
FIG. 4 is a schematic of the present invention where the cup plug has landed in a profile that is located in a sliding sleeve. This condition exists when it is not desired to perforate above the plug but instead break down the formation by applying frac pressure.

FIG. 4 shows a cross-section of the cup plug 36 inside of liner 1, which is connected to liner collar 44 with thread 43, and sliding sleeve 52. Key profile 21 is landed into sliding sleeve profile 20 so cup plug 36 engages and locks into sliding sleeve 52. Cup 9 seals inside of sliding sleeve 52. Seals 45 and 48 seal in bores 49 and prevent fluid form passing through ports 46. Shear screws 47 secure sliding sleeve 52 to collar 44 by engaging shoulders 51. Shoulder 50 is positioned at the top of collar 44.

Figure 5:
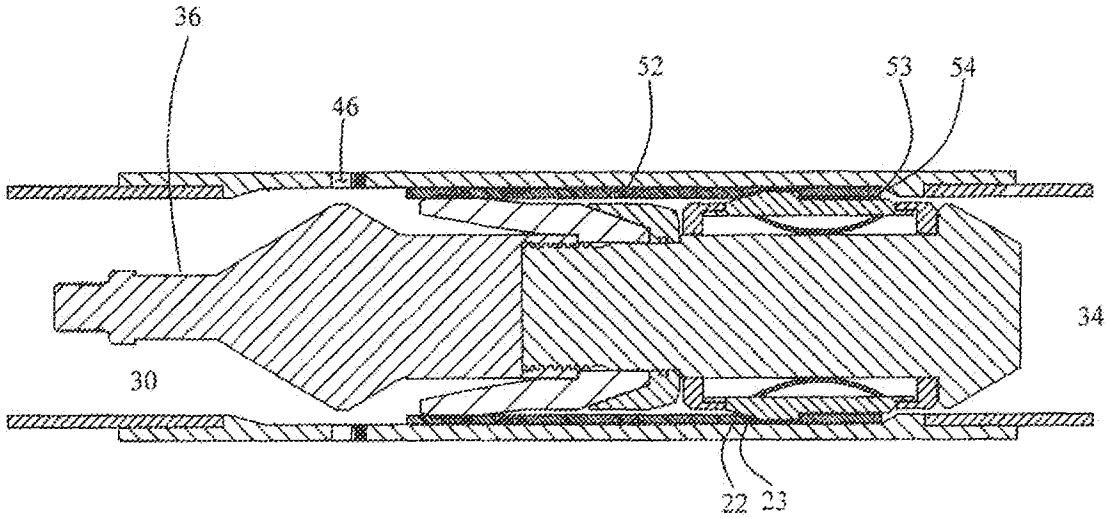
FIG. 5 is a schematic of the present invention where the cup plug has landed in a profile that is located in a sliding sleeve and applied pump pressure has acted on the cup to create a force to shift the sleeve down to uncover a series of frac ports.

FIG. 5 shows the sleeve 52 shifted downward so that shoulder 53 contacts shoulder 54. Frac ports 46 are exposed to fluid 30 so that fluid 30 can pass through ports 46.

Figure 6:
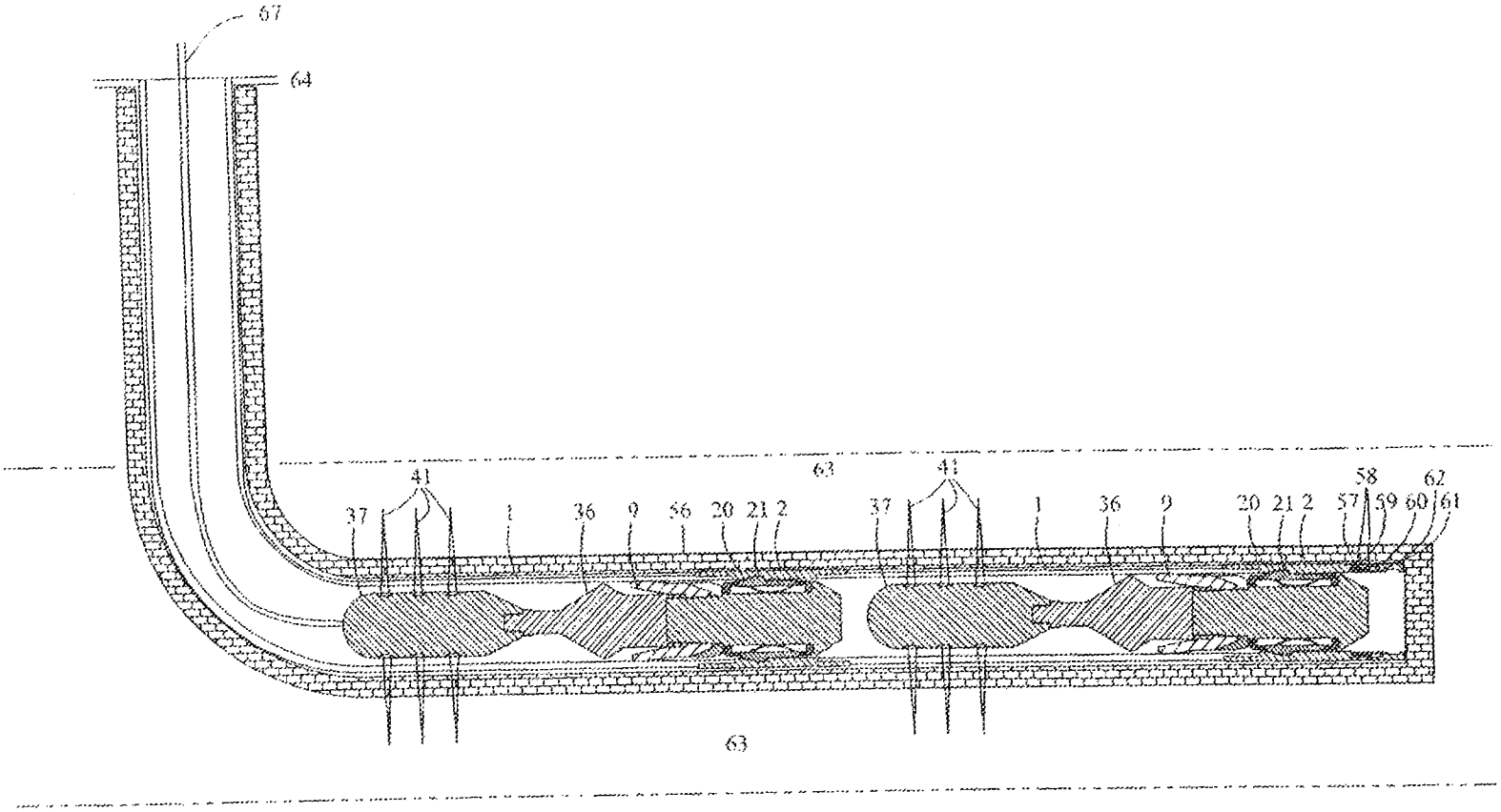
FIG. 6 is a schematic of the present invention that shows two cup plugs, with wireline perforating guns attached, pumped into the horizontal section landed in collar profiles.

FIG. 6 shows well liners 1 and collars 2 in formation 63. At the toe end of the well is circulation valve 57 that consists of differential piston 60, seals 58 and 62 on the piston 60, port 59, and housing 61. The cup pug 36 and perforating gun 37 are connected and are positioned at two separate zones in the well liner 1. The perforating guns 37 are shown making perforations 41 to communicate with zones 63. Wireline 67 is shown connected to perforating gun 37 and going to surface 64.

Figure 7:
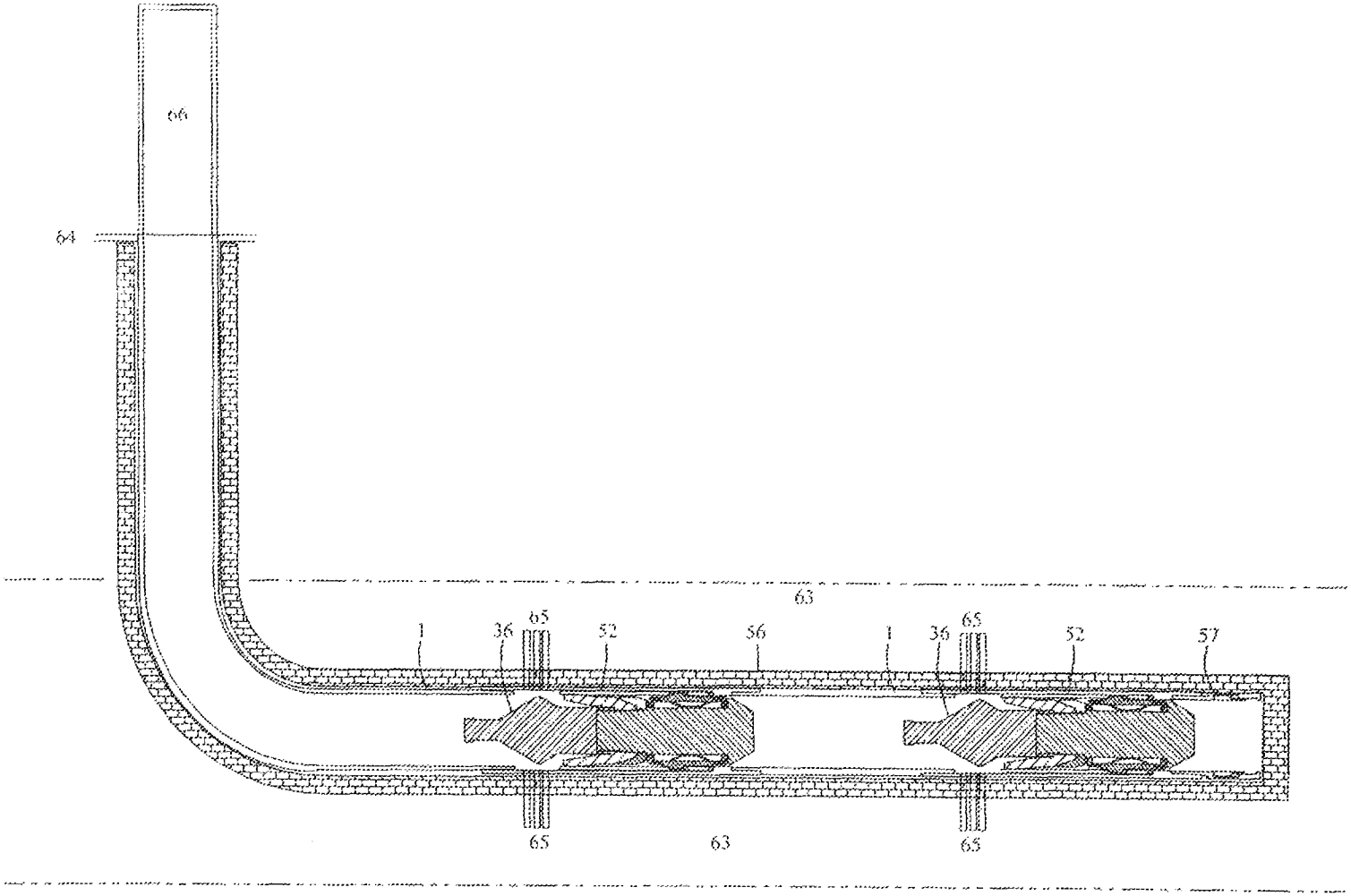
FIG. 7 is a schematic of the present invention that shows two cup plugs and sliding sleeves in a horizontal wellbore. Only two are shown but many can be used.

FIG. 7 shows the cup plugs 36 positioned in two sliding sleeves 52 that are connected to liners 1. Liners 1 and sliding sleeves 52 are cemented 56 into zone 63. Fractures 65 are shown propagating from the sliding sleeve ports into formation 63. Lubricator 66 is shown positioned at the surface 64 to catch the cup plugs when production begins. Circulation valve 57 is shown at the toe of the well. The circulation valve can be replaced with any device or method that allows circulation to the toe of the wellbore.

DESCRIPTION OF OPERATION

Referring to FIG. 1, cup plug 36 is pumped through the well liner 1 by applying fluid pressure 30 to cup 9. The area created by cup surface 27 sealing on liner surface 26 times the applied pump pressure creates a force to move cup plug out the horizontal wellbore. Thimble 10 acts as a backup to cup 9 so the cup 9 can withstand high frac pressures applied during fracing. The o-ring 12 prevents fluid from passing under the cup 9. Finned centralizer 7 keeps cup 9 centered in liner 1 for improved sealing. Keys 15 are expandable and retractable and are biased outward with spring force from spring 16. When key profile 21 enters collar profile 20 the keys expand and snap into the profile and shoulders 24 and 25 engage so that the cup plug 36 cannot go down past the collar profile. The engagement between shoulders 24 and 25 is of sufficient strength as to prevent the cup plug 36 from moving down when frac pressure 30 is applied to the cup 9. The top of the cup plug 36 has thread 5 to allow attachment of wireline tools and has a fish neck if retrieval operations are ever needed. After fracing the zones in the well the cup plug is flowed back to the surface by flow due to production. The keys 15 have gradual profiles 23 that contact gradual collar profiles 22 so that little force is needed to retract keys 15 so that the cup plug 36 can move upward. Hole 68, pocket 72, and holes 71 are present so that production fluids will clean any proppant settlement out from under cup 9 that might prevent the plug from moving upward. The flow area through hole 68 is small so that a differential will remain higher below the cup plug so that the plug will move upward. The ball 70 seals on seat 69 to prevent the passage of frac fluid or pumping fluid. The key profiles and collar profiles are placed throughout the length of the horizontal wellbore typically with longer profile near the toe of the well and shorter profile near the surface of the well. The longer profiles will pass the shorter profiles until the matching profile is reached by the cup plug and the cup plug will latch in and stop.

Referring to FIG. 3, the perforating gun 37 is attached to the cup plug 36 and a wireline is attached to the perforating gun, see FIG. 6. The cup plug 36 is pumped down to a liner collar that has a matching profile to the cup plug. The cup 9 seals inside of liner 1 to prevent frac fluids from passing the cup plug. Perforating gun 37 can be detached, if desired, and moved to a location where it is desired to perforate liner 1. The perforating gun is removed from the well and the zone if fraced. This process is repeated for the planned number of zones to be fraced. After fracing the well production flows the cup plugs back to the surface which leaves a full bore through the liner and no need to mill out the plugs.

Referring to FIGS. 4 and 5, the cup plug 36 is used in this case when it is desired not to run perforating guns, but instead, open flow holes 46 to the formation by shifting a sliding sleeve 52. Once the spring loaded key with profile 21 lands into sliding sleeve with profile 20, and the cup plug locks into sliding sleeve 52, pump pressure applied to cup 9 shifts the cup plug and sliding sleeve 52 downward, shearing shear screws 47 and allowing seal 45 to cross port 46 to allow fluid communication from inside the liner 1 to the outside of liner 1. The cup 9 seals inside of the sliding sleeve so that frac fluid is directed into the well formation. As shown in FIG. 7, multiple cup plugs can be pumped into position, the zones fraced, and the plugs flow back to surface when production begins. In to above described operation, no wireline runs are required and no coiled tubing milling operations are needed. Also it is possible to omit the sealing cup so that the mandrel and the expanding keys are sufficient to divert fracturing fluid to a point above the plug into the formation.

Those familiar with the art of completing wells realize that other advantages might exist with the present invention, such as making the cup plug out of composite materials or adding a means to prevent the cup plug from rotating should the occasion arise where the cup plug would have to be milled out. Also, for example, the cup plug could be run with other types of completion systems as desired.

I claim:

1. A plug for an oil/gas well comprising:

a mandrel;

a seal attached to the mandrel and adapted to contact an inner surface of a member positioned within the well;

a backup thimble for supporting the seal, and a plurality of radially positioned keys that are spring biased in a radial direction to selectively engage a profile provided in the inner surface of the member positioned within the well, and an internal bore for fluid flow within the mandrel and a check valve for preventing flow in a down hole direction.

2. A plug as claimed in claim 1 wherein the keys include a shoulder adapted to rest against a shoulder provided in the profile to prevent down hole movement of the plug.

3. A plug as claimed in claim 2 wherein the keys further include a sloping surface which is adapted to engage a sloping surface in the profile whereby production flow from the formation to a wellhead will cause the keys to disengage from the profile to allow the plugs to flow back to the surface.

4. A plug according to claim 1 wherein the seal is a sealing cup that is flexible and has surface exposed to fluid being pumped down the well such that when fluid is pumped down the well, the flexible cup will expand outwardly to seal against said member secured within the well.

5. An apparatus for fracing production zones in a well, comprising:

a plurality of members positionable within the well at spaced locations, each member having a unique key profile;

a plurality of plugs adapted to be placed within the well in a sequential order, each plug having a unique key for selective engagement with the unique key profile provided on the members, each plug further including a seal allowing the plug to be pumped down into the well, the seal also preventing flow around the plug when the plug is held in place within the member when the key and key profiles are matched, wherein the key has a sloping surface allowing the key to disengage from the key profile when the well is producing to allow the plugs to flow back to the surface of the well.

6. The apparatus according to claim 5 wherein the members are liner collars for connecting together two casing liners.

7. The apparatus according to claim 5 wherein the members are shiftable sleeves securable to liner collars.

8. The apparatus according to claim 7 wherein the liner collars include fracing ports that are opened when the shiftable sleeves are moved in a downhole direction.

9. The apparatus as claimed in claim 5 further including a perforating gun attached to each plug.

10. A method of hydraulically fracturing a plurality of production zones in a well having a wellhead comprising:

securing within the well a plurality of members each having a unique key profile in a surface thereof;

introducing a first plug having a seal and a key that matches the key profile of the member furthest from the wellhead into the well so that the member captures the plug and fluid flow around the plug is prevented;

forming a first plurality of fracturing ports through the well so as to allow fracturing fluid to penetrate the production zone around the well;

pumping fracturing fluid into the well and through the fracturing ports and into the production zone;

introducing a second plug having a second unique key that matches the key profile of the second furthest member secured within the well so that the second plug is captured by the second member;

forming a second plurality of ports through the well to allow fracturing fluid to penetrate a second production zone;

pumping fracturing fluid into the well and through the second plurality of ports into the production zone, and flowing back the plugs to the well surface.

11. The method of claim 10 wherein a perforating gun is attached to each plug prior to being positioned within the well.

12. The method of claim 10 wherein the member includes a shiftable sleeve having the key profile in a surface thereof and wherein the ports are opened as the shiftable sleeve is moved.

13. The method of claim 12 wherein the shiftable sleeves are moved as a result of capturing a plug.

14. A plug for an oil/gas well comprising:

a mandrel;

a seal attached to the mandrel and adapted to contact an inner surface of a member positioned within the well;

means for selectively engaging a profile provided in the inner surface of the member positioned within the well, including a plurality of radially positioned keys that are spring biased in a radial direction to engage the profile on the inner surface of said member, and an internal bore for fluid flow within the mandrel and a check valve for preventing flow in a down hole direction.

15. A plug for an oil/gas well comprising:

a mandrel;

a seal attached to the mandrel and adapted to contact an inner surface of a member positioned within the well;

means for selectively engaging a profile provided in the inner surface of the member positioned within the well including a plurality of radially positioned keys that are spring biased in a radial direction to engage the profile on the inner surface of said member, said keys including a shoulder adapted to rest against a shoulder provided in the profile to prevent down hole movement of the plug, said keys further including a sloping surface which is adapted to engage a sloping surface in the profile whereby production flow from the formation to a wellhead will cause the keys to disengage from the profile to allow the plugs to flow back to the surface.

* * * * *